US009884710B2

(12) United States Patent
Nishikawa et al.

(10) Patent No.: US 9,884,710 B2
(45) Date of Patent: Feb. 6, 2018

(54) LID MEMBER FOR PRESS-THROUGH PACKAGE AND PRESS-THROUGH PACKAGE PACKING BODY

(71) Applicant: TOYO ALUMINIUM KABUSHIKI KAISHA, Osaka (JP)

(72) Inventors: Hiroyuki Nishikawa, Osaka (JP); Tomonobu Sekiguchi, Osaka (JP); Kazunori Yamada, Osaka (JP); Hiroshi Kubo, Osaka (JP); Masahiro Sato, Osaka (JP); Shuichi Chiba, Osaka (JP)

(73) Assignee: TOYO ALUMINIUM KABUSHIKI KAISHA, Osaka (JP)

( * ) Notice: Subject to any disclaimer, the term of this patent is extended or adjusted under 35 U.S.C. 154(b) by 198 days.

(21) Appl. No.: 14/777,575

(22) PCT Filed: Feb. 27, 2014

(86) PCT No.: PCT/JP2014/054874

§ 371 (c)(1),
(2) Date: Sep. 16, 2015

(87) PCT Pub. No.: WO2014/148222

PCT Pub. Date: Sep. 25, 2014

(65) Prior Publication Data

US 2016/0272397 A1 Sep. 22, 2016

(30) Foreign Application Priority Data

Mar. 21, 2013 (JP) ..... 2013-058062

(51) Int. Cl.
*B65D 75/36* (2006.01)
*B65D 75/32* (2006.01)

(52) U.S. Cl.
CPC .... *B65D 75/327* (2013.01); *B65D 2575/3254* (2013.01)

(58) Field of Classification Search
CPC ..... B65D 75/325; B65D 75/36
(Continued)

(56) References Cited

U.S. PATENT DOCUMENTS 8,740,003 B2 * 6/2014 Elliott ..... B65D 75/327 206/538
2010/0243508 A1 9/2010 Sekiguchi et al.
2011/0247305 A1 * 10/2011 Nelson ..... A61J 1/035 53/453

FOREIGN PATENT DOCUMENTS

CN 201052881 4/2008
CN 102470626 5/2012
(Continued)

OTHER PUBLICATIONS

International Search Report dated May 20, 2014 in International Application No. PCT/JP2014/054874.
(Continued)

*Primary Examiner* — King M Chu
(74) *Attorney, Agent, or Firm* — Wenderoth, Lind & Ponack, L.L.P.

(57) ABSTRACT

A lid member for a press-through package, and a press-through package packing body using the same, includes a lid member which is not to be inadvertently torn, while tablets or capsules as its contents can be removed under a uniform opening strength by a predetermined force or more using fingers. The lid member of the packing body includes a resin film, an adhesive, an aluminum foil, and a thermal adhesive layer, in which tapered through holes are formed in the resin film. The resin film is laminated to the aluminum foil to reinforce the lid member so that the lid member is not to be inadvertently torn. When contents of a container are pushed
(Continued)

out using fingers, the lid member is broken starting from the tapered through holes provided in the resin film, and so the contents can be easily taken out.

6 Claims, 2 Drawing Sheets

(58) Field of Classification Search
USPC ..... 206/461, 531, 532, 528
See application file for complete search history.

(56) References Cited

FOREIGN PATENT DOCUMENTS

| | | |
|---|---|---|
| DE | 44 02 038 | 7/1995 |
| JP | 1-161469 | 11/1989 |
| JP | 6-39015 | 2/1994 |
| JP | 6-81982 | 11/1994 |
| JP | 3035462 | 3/1997 |
| JP | 10-167320 | 6/1998 |
| JP | 2006-1591 | 1/2006 |
| JP | 2008-155956 | 7/2008 |
| WO | 2006/048687 | 5/2006 |
| WO | 2009/057507 | 5/2009 |

OTHER PUBLICATIONS

Written Opinion of the International Searching Authority issued in International Application No. PCT/JP2014/054874 and its English translation.

Written Opinion of the International Preliminary Examining Authority issued in International Application No. PCT/JP2014/054874and its English translation.

* cited by examiner

LID MEMBER FOR PRESS-THROUGH PACKAGE AND PRESS-THROUGH PACKAGE PACKING BODY

TECHNICAL FIELD

The present invention relates to a lid member for a press-through package and a press-through package packing body using the same. (The term "blister package" is also employed in some areas, but the term "press-through package" is employed in this specification.)

BACKGROUND ART

As disclosed in Japanese Unexamined Patent Application Publication No. 2006-1591, in a press-through package (hereinafter the press-through package is also referred to as "PTP") packing body that has been conventionally commercially available, a lid member thereof is principally composed of aluminum foil and a thermal adhesive layer. Applying a pressure using fingers to container portions of the packing body allows pharmaceutical products, such as tablets or capsules, that are contents to break through the lid member and to be easily taken out. Therefore, the PTP packing body has been widely used in hospitals, pharmacies, and drug stores.

When the PTP packing body of this type is put in a pocket of clothes, a bag, a sack, or the like to be carried with, or several packing bodies are kept together, the lid member may be inadvertently torn and holes may be made. As a result, pharmaceutical products may react with a large amount of oxygen and water in the external air so as to be less efficacious. Moreover, it is undesirable for pharmaceutical products to inadvertently jump out, which is above all unsanitary. Further, since the lid member is to be easily torn, accidents in which children accidentally swallow pharmaceutical products constantly occur, and a so-called child-resistant function (that is, a function of preventing inadvertent opening and accidental swallowing by children) is absent.

On the other hand, WO 2006/048687 discloses, as a lid member for a PTP packing body, a member in which a resin film incorporating perforations is laminated to an outer side of aluminum foil. In this lid member, the resin film is laminated to the aluminum foil so that the aluminum foil is less easily torn as compared to the lid member in Japanese Unexamined Patent Application Publication No. 2006-1591 and the child-resistant function is also included.

However, in the PTP packing body in WO 2006/048687, the perforations incorporated in the resin film are continuous in a particular direction so that the strength of the lid member is oriented and a force for removing capsules or the like that are contents is not uniform. Moreover, the lid member is to be easily torn directly at the perforations, while not to be easily torn at parts without the perforations, and pharmaceutical products that are contents are not to be easily removed.

SUMMARY OF THE INVENTION

Accordingly, it is an object of the present invention to provide a lid member for a press-through package and a press-through package packing body using the same, in which, even when the PTP packing body is put in a pocket of clothes, a bag, a sack, or the like to be carried therewith, or several packing bodies are kept together, the lid member is not to be inadvertently torn and an opening strength is substantially uniform, while tablets or capsules that are contents are allowed to be taken out by a uniform force or more using fingers.

A lid member for a press-through package of the present invention includes a resin film, an aluminum foil layer, and a thermal adhesive layer, which, preferably, are laminated to one another in this order, in which tapered through holes are formed in the resin film. Thereby, the resin film is laminated to the aluminum foil layer to reinforce the lid member so that the lid member is not inadvertently torn, while the lid member is broken starting from the tapered through holes provided in the resin film when performing a pushout using fingers, and contents can be taken out by a uniform force.

Effect of the Invention

According to, for example, the lid for a PTP of the present invention, the lid member is not to be inadvertently torn and an opening strength is uniform, while tablets or capsules that are contents can be removed by a uniform force or more using fingers.

DETAILED DESCRIPTION OF THE INVENTION (1. Configuration of Lid Member)

A lid member 10 for a PTP according to an embodiment of the present invention includes at least a resin film 11, an aluminum foil layer 13, and a thermal adhesive layer 14, in which tapered through holes 11*a* are formed in the resin film 11.

Figure 1:
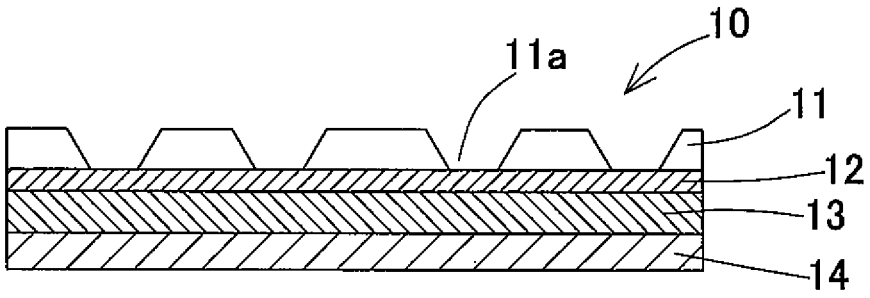
FIG. 1 is a schematic sectional view of a lid member for a PTP according to an embodiment of the present invention.

As a preferred embodiment of the lid member 10, as illustrated in FIG. 1, the resin film 11 in which the through holes 11*a* are formed is provided as an outermost layer; the aluminum foil layer 13 is provided as an intermediate layer (barrier layer); and the thermal adhesive layer 14 is provided as an innermost layer (container side). As illustrated in this drawing, an adhesive 12 may be arranged between the resin film 11 and the aluminum foil layer 13.

The resin film 11 is not limited to a particular kind and the like, and a known resin film may be used. Resin films usable as the resin film 11 include polyethylene film, polypropylene film, polyester film, polyamide (nylon) film, (meth)acrylic resin, polyvinyl chloride resin, polystyrene resin, polyvinylidene chloride resin, saponified ethylene-vinyl acetate copolymer, polyvinyl alcohol, polycarbonate resin, polyvinyl acetate resin, and acetal resin. The film of such a resin may be monoaxially or biaxially oriented, or non-oriented. In view of the press through function, a resin film having an edge-tear resistance of 70 N or less is particularly preferable, and a resin film having an edge-tear resistance of 20-60 N is more preferably used. Such resin films include "TEARFINE® TF 110" polyester film manufactured by Toyobo Co., Ltd. (with edge-tear resistance of 45 N (longitudinal) and 45 N (transverse)). By using a resin film having an edge-tear resistance of 70 N or less (or more preferably 20-60 N), the press through function improves, and the contents can be individually removed more smoothly. The edge-tear resistance can be measured in accordance with JIS C 2318 (with a sample width of 20 mm).

The resin film 11 preferably has a thickness of approximately 9-25 μm. If the thickness is less than 9 μm, the rigidity of the resin film is low, and the hole-forming process as described below may become difficult. Conversely, if the thickness is larger than 25 μm, the rigidity of the resin film is too high, which may inhibit the press through function.

As the aluminum foil layer 13, an aluminum foil used for known PTPs may be used, and a soft, semi-hard, or hard material having a thickness of approximately 10-30 such as (JIS) 1N30, 8021, or 8079, is preferably adopted. If the thickness of the aluminum foil is less than 10 a moisture resistance may be poor. Conversely, if the thickness of the aluminum foil is larger than 30 μm, the press through function may be inhibited.

How the aluminum foil 13 and the resin film 11 are laminated to each other is not particularly limited, but a dry lamination method using a dry lamination adhesive is preferably performed.

To the aluminum foil 13, a printing layer, a colored layer, a primer coat layer, or the like may be laminated to be interposed, as appropriate.

As the thermal adhesive layer 14, a thermal adhesive layer (thermal adhesive) used for known PTPs may be used, and a polypropylene adhesive, a vinyl chloride adhesive, a vinyl chloride-vinyl acetate copolymer adhesive, or the like may be used. The application amount of the thermal adhesive is preferably approximately 0.5-15 g/m$^2$ in terms of weight after drying. Heat sealing during manufacture of the packing body is usually conducted for approximately one to three seconds at approximately 140-260° C. The sectional shape after sealing may be a mesh seal having a continuously rugged (notched) shape.

The main configuration of the PTP lid member 10 of the present invention has been described above, but as necessary, an anchor coat layer, a vapor-deposited layer of e.g. alumina or silica, a primer coat layer, a printing layer, a colored layer, a barcode layer, a key lacquer layer, an overcoat layer, or the like may be also provided.

The method for laminating the respective layers is not particularly limited, and a known method may be employed. For example, a dry lamination method, a wet lamination method, heat lamination, an extrusion lamination method, application lamination by gravure printing or roll coating, or the like, using polyester or polyurethane adhesive, may be employed.

(2. Forming Holes in the Resin Film)

The resin film 11 used in the present invention is subjected to a hole-forming process for forming the through holes 11*a*. This process is not particularly limited. For example, the through holes 11*a* may be formed by a laser process, a melting process using hot needles, a melting perforation using a solvent, a machining process using a roller with projections, and the like. The through holes 11*a* are preferably taper-shaped, and particularly preferably, as illustrated in FIG. 1, the through holes 11*a* are taper-shaped in such a manner as to converge toward the inner surface side of the lid member 10 (thermal adhesive layer 14 side. In other words, the through holes 11*a* diverge toward the outer surface side of the PTP packing body to provide a child-resistant function. Specifically, since the through holes 11*a* become smaller toward the inner surface side of the lid member 10, the lid member 10 is less likely to be broken from the inner surface side, that is, from inside a container 20.

The taper angles of the through holes 11*a*, which are angles of inclination from a direction orthogonal to the front and back surfaces of the resin film, are preferably approximately 1-45 degrees, and more preferably 3-30 degrees. Within these angles, the child-resistant function, the outer surface protection function, and ease of taking out the contents can all be maintained at the same time. Specifically, if the taper angles are larger 45 degrees, the through holes 11*a* excessively enlarge toward the outer surface side of the lid member 10 so that the outer surface protection function may be insufficient. On the other hand, if the taper angles are less than one degree, the through holes 11*a* hardly narrow toward the inner surface side of the lid member 10 so that the child-resistant function may be insufficient.

If, for example, through needles (projections) are used for forming the through holes, the taper angles can be appropriately adjusted by, for example, selecting through needles each having a tip end angle thereof corresponding to the desired taper angle.

The shape of each through hole 11*a* in plan view may be a polygon or a triangle. However, since a polygon has angular corners on which a load concentrates so that the lid member 10 may be inadvertently broken, a substantially circular shape or a substantially oval shape without parts on which a load concentrates is preferable.

The number of through holes 11*a* is not particularly limited, but is preferably in a range of 100-10,000 per square centimeter, and more preferably 1,500-5,000 per square centimeter. Within this range, the strength as the lid member, the ease of taking out the contents, and the child-resistant function are optimal.

As the size of the through holes 11*a*, their average area (i.e. the area per through hole in plan view (at the larger end of the taper)) is preferably $10^{-8}$-1 mm$^2$, and more preferably $10^{-6}$-$10^{-2}$ mm$^2$. By determining the average area of the through holes in plan view to be $10^{-8}$-1 mm$^2$, it is possible to reliably take out the contents using fingers. If the area per through hole in plan view is less than $10^{-8}$ mm$^2$, the press-through property may deteriorate; that is, it may become difficult to open the lid member by pushing out the contents using fingers. On the other hand, if the area per through hole in plan view is larger than 1 mm$^2$, the aluminum foil layer 13, which serves as the foundation layer, is excessively exposed, and the effect of protecting the aluminum foil by the resin film may decrease. In the present invention, the area of each through hole in plan view is its area at the larger end of the taper, and is given as a value calculated by multiplying the maximum diameter of the through hole (maximum distance between any two line segments sandwiching the through hole) and the distance between the two line segments orthogonal to the maximum diameter.

Figure 3:
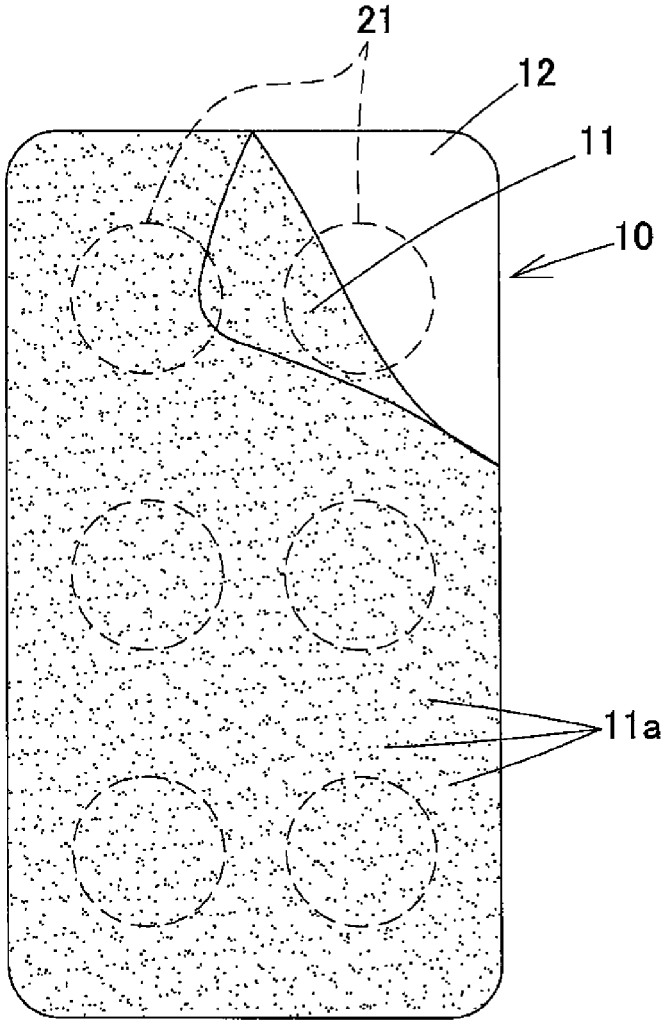
FIG. 3 is a plan view of the PTP packing body as seen from a lid side according to the embodiment of the present invention.

As illustrated in FIG. 3, the through holes are preferably arranged in a random manner in plan view of the resin film; that is, arranged such that directivity as seen in perforations is absent. In FIG. 3, in order to show that the through holes 11*a* penetrate through the resin film 11, the resin film 11 is partially folded over in a forced manner. By arranging the through holes 11*a* in a random manner, unevenness of the breaking strength of the resin film (opening strength of the lid member) depending on locations is overcome, which makes it possible to open the lid member with a uniform force at any portion of the lid member and take out the contents.

Moreover, by arranging the through holes 11*a* in the lid member 10 in a random manner in plan view and in large number within the range of 100-10,000 per square centimeter, it is possible to eliminate the necessity of positioning housing portions 21 of the container 20 relative to the through holes 11*a* when the lid member 10 is placed over the container 20. Specifically, since the through holes 11*a* are provided in large number and distributed uniformly over the entire area of the lid member 10, sufficient numbers of the through holes 11*a* are assuredly present at the locations facing the boundaries between the housing portions 21 and flange portions 22 of the container (that is, at the locations at which breakage occurs during press-through) Accordingly, the effect of the present invention can be assuredly obtained.

(3. Configuration of Packing Body)

Figure 2:
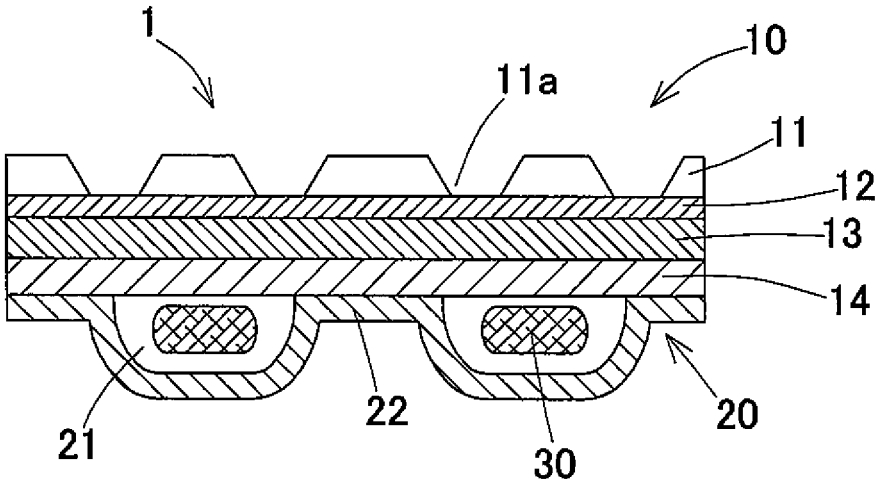
FIG. 2 is a schematic sectional view of a PTP packing body according to the embodiment of the present invention.

The PTP packing body 1 according to the embodiment of the present invention is, as illustrated in FIGS. 2 and 3, a packing body in which the lid member 10 of the embodiment and the flange portions 22 of the container 20, in which the housing portions 21 for the contents 30 are formed, are adhered to each other by heat adhesion.

As the container 20 of the packing body 1, containers similar to conventional containers may be used. For example, as illustrated in FIG. 2, a known container in which pockets as the housing portions 21 for the contents 30 are formed between the flange portions 22 may be used. The container 20 may be formed using a resin sheet of polypropylene, vinyl chloride, or the like, for example, by plug-assist forming, vacuum or air-pressure forming, vacuum/pressure forming, hot press forming, or the like. A commercially available PTP container may also be used. After the contents 30, such as tablets or capsules, are housed in the housing portions 21, the lid member 10 is placed over opening portions of the container 20 (that is, over the housing portions 21), and the flange portions 22 of the container and the lid member 10 are bonded to each other by thermal adhesion to seal the openings of the container 20. Thus, the packing body of the present invention is thus obtained. This thermal adhesion (heat sealing) is not particularly limited, and is usually performed at 100-260° C. for 0.1-3 seconds at 0.1-0.5 MPa, approximately.

The container 20 partitions the lid member 10 into portions facing the housing portions 21 and portions adhered to the flange portions 22 by thermal adhesion. Preferably, the individual housing portions 21 have an average area, in plan view, of 5-900 $mm^2$, to ensure sufficiently large exits through which the contents 30 can be removed from the housing portions 21.

The container 20 may house as the contents 30, in addition to pharmaceutical products such as tablets and capsules, chemical products such as aromatic agents, dehumidifying agents, moth-proofing agents, and deodorizing agents, sweets such as chocolate pieces and candies, electronic or electric components (products) such as integrated circuit (IC) chips, semiconductor components, light emitting diodes (LEDs), and button batteries, and the like.

EXAMPLES

With respect to examples according to the present invention and a comparative example, tests for evaluating a press-through property (child-resistant function) and a tear prevention property were performed. Test samples comprised a total of five samples corresponding to the below Examples 1-4 and Comparative Example 1, respectively.

Examples 1 and 2

A predetermined number (shown in Table 1) of through holes were formed in a polyethylene terephthalate film ("TEARFINE® TF 110" manufactured by Toyobo Co., Ltd.) having a thickness of 14 μm using conical projections in a random manner in plan view. The through holes were taper-shaped, and the taper angles were approximately 20 degrees. The average size of the through holes is also shown in Table 1.

Subsequently, for each of Examples 1 and 2, which are different from each other in the taper direction of the through holes, using a polyurethane dry lamination adhesive (3 $g/m^2$ in terms of weight after drying), one surface of the film was dry-laminated to one surface of an aluminum foil (manufactured by Toyo Aluminium Kabushiki Kaisha, 1N30, soft foil) having a thickness of 20 Thereafter, a vinyl chloride thermal adhesive (5 $g/m^2$ in terms of weight after drying) was applied to the other surface of the aluminum foil using a gravure roll and dried so as to manufacture lid members of Examples 1 and 2 of the present invention.

Examples 3 and 4

Lid members of Examples 3 and 4 were manufactured in the same manner as in Examples 1 and 2, except that the polyethylene terephthalate film had a thickness of 12 μm ("E5100" manufactured by Toyobo Co., Ltd.).

Comparative Example 1

As a comparative product, to one surface of an aluminum foil (manufactured by Toyo Aluminium Kabushiki Kaisha, 1N30, soft foil) having a thickness of 20 μm, a vinyl chloride thermal adhesive (5 $g/m^2$ in terms of weight after drying) was applied using a gravure roll and dried so as to manufacture a lid member of Comparative Example 1.

The following various tests and measurements with respect to the above test samples were performed.

TABLE 1

| | Taper direction | Number of Through Holes/$cm^2$ | Average Size of Through Holes |
|---|---|---|---|
| Example 1 | Diameter Expanding Toward Outer Surface Side | 1900 | $9.2 \times 10^{-4}$ $mm^2$ |
| Example 2 | Diameter Expanding Toward Inner Surface Side | 1900 | $9.2 \times 10^{-4}$ $mm^2$ |
| Example 3 | Diameter Expanding Toward Outer Surface Side | 2850 | $5.1 \times 10^{-4}$ $mm^2$ |
| Example 4 | Diameter Expanding Toward Inner Surface Side | 2850 | $5.1 \times 10^{-4}$ $mm^2$ |
| Comparative Example 1 | — | — | — |

<Manufacture of Packing Bodies and Press-Through Test>

The lid members of Examples 1-4 of the present invention and Comparative Example 1 were heat-sealed to the flange portions of separately prepared commercially available containers for press-through packages under the conditions of 170° C.×three seconds×0.5 MPa. Before heat sealing, a Shin Biofermin S tablet of a diameter of approximately 8 mm×a thickness of approximately 4.2 mm manufactured by Biofermin Pharmaceutical Co., Ltd. was put in advance in each housing portion (pocket) of the container. The pockets of the containers had a size of a diameter of 10 mm×a depth of 5 mm.

Table 2 shows the results of a test in which each of a group of test users consisting of five three-to-five-year-old children and five 80-year-old aged people pressed the bottom of the container of each manufactured packing body (pocket portion at a side opposite to the lid member) using fingers in order to check whether the tablets broke through the lid member and were taken out.

In Table 2, the symbol "○" denotes that all the five test users could take out the tablets within 10 seconds; the symbol "Δ" denotes that three to four people could take out the tablets within 10 seconds, and the symbol "x" denotes that only two or less people could take out the tablets within 10 seconds.

TABLE 2

| | Three-to-five-year-old Child | 80-year-old Aged Person |
|---|---|---|
| Example 1 | x | ○ |
| Example 2 | Δ | ○ |
| Example 3 | x | ○ |
| Example 4 | x | ○ |
| Comparative Example 1 | ○ | ○ |

<Measurements of Lid Member Strength>

(1) Evaluations of Tear Prevention Property

A punch having a semi-spherical tip end having a radius of 0.5 mm was pierced through each lid member from the PET surface (aluminum foil surface in Comparative Example 1) side thereof at a speed of 50 mm/min, and the maximum load required for the punch to penetrate through the lid member was measured. Table 3 shows the average values at n=6. Inadvertent tear by projections is supposed, a piercing strength of 3.0 N or more indicates that tear is unlikely to occur and a tear prevention property is favorable.

(2) Evaluations of Press-Through Property

Each packing body was manufactured in the same manner as in item 1 above; the bottom portion at a container side was removed; a tablet was pressed through the removed portion using a cylindrical push-out jig having a tip end radius of 2.5 mm at a speed of 50 mm/min; and the maximum load when the lid member is broken by the tablet was measured. Table 3 shows the average values at n=10. Within a range of 30-60 N, the child-resistant property and the ease of taking out the contents (age-friendly) are favorable.

TABLE 3

| | Lid Member Strength/N | |
|---|---|---|
| | (1) Tear Prevention Property | (2) Press-through Property |
| Example 1 | 4.6 | 43.8 |
| Example 2 | 4.8 | 42.7 |
| Example 3 | 6.3 | 57.7 |
| Example 4 | 6.5 | 55.9 |
| Comparative Example 1 | 2.1 | 19.6 |

In the above, the embodiment and the examples of the present invention have been described. However, the embodiment and the examples of the present invention as disclosed above are only exemplary, and the scope of the present invention is not limited to these embodiments of the present invention. The scope of the present invention is defined by the claims and encompasses all changes that are made to the claims within the meanings and scope that are equivalent to the claims.

Figure 4:
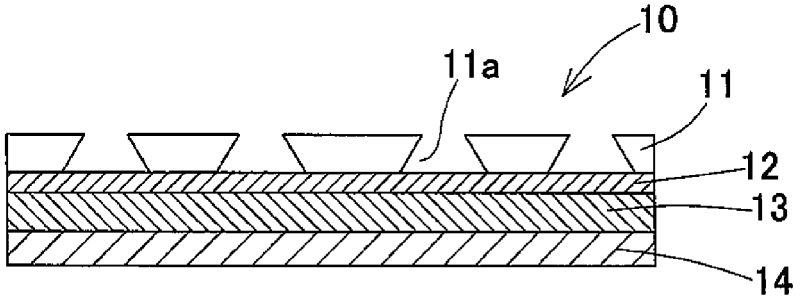
FIG. 4 is a schematic cross-sectional view of a lid member for a PTP according to another embodiment of the present invention.

For example, as illustrated in FIG. 4, the through holes 11*a* of the lid member 10 may also be taper-shaped in such a manner as to converge toward the outer surface side of the lid member 10. In this case, the through holes 11*a* become smaller toward the outer surface side of the lid member, which is favorable in view of outer surface protection function.

DESCRIPTION OF SYMBOLS

1 packing body
10 lid member
11 resin film
11*a* through hole
12 adhesive
13 aluminum foil
14 thermal adhesive layer
20 container
21 housing portion
22 flange portion
30 contents

The invention claimed is:

1. A lid member for a press-through package, comprising:
a resin film;
an aluminum foil; and
a thermal adhesive layer,
wherein a plurality of tapered through holes are formed in the resin film, and the through holes are arranged in a random manner in plan view of the resin film, the through holes being taper-shaped so as to diverge toward an inner surface side of the lid member.

2. The lid member for a press-through package according to claim 1, wherein the through holes are formed in a quantity within a range of 100-10,000 per square centimeter.

3. A press-through package packing body, comprising:
a container having a housing portion configured to accommodate contents; and
the lid member according to claim 1, wherein the lid member is laminated to the container in such a manner as to close an opening of the housing portion.

4. The press-through package packing body according to claim 3, wherein the container and the lid member are configured such that applying a pressure using fingers to the housing portion allows contents to break through the lid member and be removed.

5. A press-through package packing body, comprising:
a container having a housing portion configured to accomodate contents; and
the lid member according to claim 2, wherein the lid member is laminated to the container in such a manner as to close and opening of the housing portion.

6. The press-through package packing body according to claim 5, wherein the container and the lid member are configured such that applying a pressure using fingers to the housing portion allows contents to break through the lid member and be easily removed.

* * * * *